United States Patent [19]

Egerer

[11] Patent Number: 4,928,356

[45] Date of Patent: May 29, 1990

[54] TOP COMB FOR TEXTILE MACHINERY AND PROCESS FOR CLEANING SAME

[75] Inventor: Josef Egerer, Schwabach, Fed. Rep. of Germany

[73] Assignee: Staedtler & Uhl, Schwabach, Fed. Rep. of Germany

[21] Appl. No.: 239,339

[22] Filed: Aug. 30, 1988

[51] Int. Cl.[5] ..... D01G 19/00

[52] U.S. Cl. ..... 19/129 R

[58] Field of Search ..... 19/2, 129 R, 215, 218, 19/220, 221, 224

[56] References Cited

U.S. PATENT DOCUMENTS 2,986,779 6/1961 Lettermann ..... 19/218

4,575,902 3/1986 Azalet ..... 19/2

FOREIGN PATENT DOCUMENTS 24486 3/1981 European Pat. Off. ..... 19/215

*Primary Examiner*—Werner H. Schroeder

*Assistant Examiner*—D. Price

*Attorney, Agent, or Firm*—Browdy & Neimark

[57] ABSTRACT

Air channels (11) are provided in a needle strip for the removal of contaminants that are deposited in the open passageways (F) between the needle points (4), which air channels can be connected to a compressed air source or a vacuum source via an air chamber (15). With die-cut and swaged needles (1), the air channels (11) are preferably formed by an extension of the swaging (10) into the region between the cover plates (2,3). Pursuant to the cleaning process, compressed air, preferably pulsed, is directed at the point region for cleaning purposes.

13 Claims, 2 Drawing Sheets

TOP COMB FOR TEXTILE MACHINERY AND PROCESS FOR CLEANING SAME

FIELD OF THE INVENTION

The invention pertains to a needle strip, especially a top comb for textile machinery and the like, and more particularly one which comprises at least one row of needles held in place by two cover plates, wherein the points of the needles extend a certain distance past the bottom edge of the cover plates, thus forming open passageways between the needles, and wherein a cleaning appliance for the removal of deposits that have settled in the open passageways is associated with the needle strip. The present invention also concerns a process for cleaning such a needle strip.

BACKGROUND

Needle strips of the general type can be disposed on various kinds of textile combs. In particular, they are used as so-called top combs in combing machines for wool or synthetic fibers, and also for cotton. In these cases, the top comb must clean out the pieces of fiber that are not captured by a circular comb located before the top comb when viewed in the direction of feed of the fiber tuft. This construction regularly causes heavy loading on top combs, and impurities in the wool or cotton, which may consist of pieces of straw or neps, settle on them. Short fibers or contaminants then lodge in the gaps between the laminar, longitudinally oriented needles.

A known process for cleaning these parts in wool combing machines is to dispose cleaning blades on both sides to rake the top combs clean after each comb cycle. Furthermore, the use of cleaning brushes in wool combing machines is known. However, these known cleaning processes thus require the expenditure of additional mechanical work in order to accomplish the cleaning operation. The cleaning blades or other cleaning elements must execute a linear movement or the top comb, if movably disposed, must be directed past the cleaning elements when it is withdrawn. Since the needles in the top comb strips are tempered, and since the cleaning elements must also be tempered abrasion occurs between the cleaning elements and the needles which can lead to the formation of burrs. In any event unavoidable wear phenomena appear.

In cotton combing machines, the available space in the vicinity of the top combs is as a rule so cramped that mechanical cleaning cannot be accomplished at all. The result of this is that the contaminants that are contained in the cotton and combed out by the top comb accumulate on the latter. They can only be removed by stopping the machine and performing manual cleaning.

SUMMARY

From this point of departure, an object of the invention is to provide a needle strip and a cleaning process for same whereby trouble-free, gentle cleaning can be obtained that does not require stopping the machine, particularly for cotton combing machines as well, achieving high reliability and at reasonable structural expense.

This object is obtained according to the invention by a needle strip wherein such needle strip comprises at least one air channel in order to direct a flow of air through or past the open passageways in order to clean them. Such a flow of air can be produced by applying either overpressure or underpressure.

The flow of air provided according to the invention is absolutely reliable in preventing large quantities of contaminants from settling, without requiring that the operation of the machine be interrupted for a manual intervention, and without mechanical wear phenomena resulting from the cleaning. Furthermore, the avoidance of mechanical cleaning arrangements also makes it possible to use such a top comb in cotton combing machines, in which cleaning of the combs during operation has hitherto not been possible at all due to the cramped spatial circumstances.

In a further embodiment of the invention, provision is made whereby at least some of the air channels are formed by an extension, in the direction of the region between the cover plates, of the open passageways between the needle points. What this achieves is that, starting at a compressed air or vacuum source, the air is directed through each open passageway thus ensuring that the entire comb is cleaned uniformly.

It is more advantageous that provision be made for a first cover plate to be shorter, viewed in the direction along the length of the needle, than the other second cover plate, with the bottom edge of the former being located in the vicinity of the beginning of the air channel and for a baffle to lie outside the first cover plate and extending to the vicinity of the bottom edge of the second cover plate, the baffle forming a closed air chamber leading to a feed or exhaust line. This achieves a restricted flow of air, which is directed to or from the air channels through the air chamber between the first cover plate and the baffle in such a way that nozzle-like airways are formed between the second cover plate and the baffle and the various needles, so that the open passageways between the needles are cleaned by directed air flows. It should also be noted that the covers in common use are made as a rule of sheet metal, but that the invention pertains to plastic covers or mountings when and if provided.

In a needle strip in which each needle is die cut, and in which the point region of the needles receives additional swaging so that the thickness of the needles in their point regions is reduced compared to that of the remaining shaft region, provision can more advantageously be made for the swaging to extend past the point region so that air channels are formed between the point region and the shaft region by the extended length of the point region. In this manner, the air channels can be produced between the needles themselves without additional manufacturing expense, so that additional construction steps need only be taken for the air supply. It is more advantageous that the length of the air channels thus formed be such that these represent approximately 15 to 100%, and preferably 60%, of the freely projecting length of the needle, i.e. of the point region. This results in a sufficiently large open air passageway while adjusting for the desired nozzle effect.

An extremely advantageous side effect when using a flow of compressed air in the arrangement according to the invention consists in that the fiber tuft, which is clamped in the jaws of the combing machines, is pressed against the circular comb segment. It is therefore easier for the fiber tuft to enter the circular comb segment. In order to reinforce this effect even more while using the compressed air line, an additional air outlet opening can be disposed in the needle point region. This can be implemented more favorably by a second baffle, disposed outside the second cover plate, which is as a rule wider.

Particularly in the case of double needle strips that comprise at least two needle strips running parallel to each other, it can be favorable to dispose an air chamber between the two rows of needles. A flow of air is then directed at or drawn away from the open passageways by such an air chamber.

The Invention also involves a process for cleaning a needle strip, according to which provision is made for the needle strip to be cleaned by compressed air. As presented, it is in principle also possible to induce a flow of air by applying a partial vacuum. However, because compressed air is available anyway in numerous industrial plants, it is especially simple to utilize such existing compressed air system in conjunction with the present invention. Furthermore, compressed air can be made available in tanks, etc.

A particularly good cleaning effect is obtained by loading the needle strip with pulsating air. Such pulsating loading pushes the individual particles of contaminants back and forth and leads to their reliable extraction. In particular, provision can be made for the air pulses to be triggered depending on the combing cycle, or on the movements of any associated jaws, or on another component of the combing machine whose actuation is coordinated. This means that one draws on the mechanical output of the top comb, which moves up and down, on the opening and closing motion of the jaws, e.g. to trigger compressed air pulses by having these motions open the valve to the compressed air source accordingly. In this manner, the removal of a contaminant is achieved immediately after it is combed out and lodges in the comb. The timing of the compressed air pulses is controlled in such a way that the contaminants blown out are taken away with the following cycle of the circular comb, i.e. a new compressed air pulse cannot be released while the take-up rollers are pulling. As an alternative, it is possible to use a timing circuit to trigger the air feed.

Preferred exemplary embodiments of needle strips according to the invention are described in greater detail below with reference to the drawing.

DETAILED DESCRIPTION OF EMBODIMENTS

Figure 1:
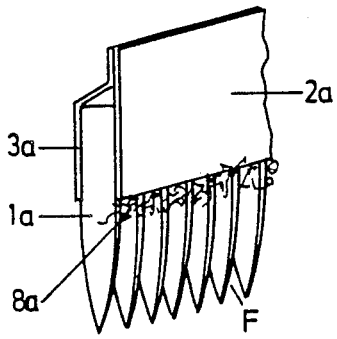
FIG. 1 shows a perspective diagonal view from the side of a conventional needle strip with contaminants deposited.
Figure 2:
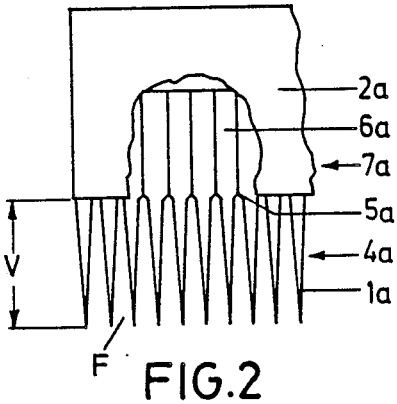
FIG. 2 shows a partial cutaway longitudinal view of a conventional needle strip.

A conventional needle strip shown in FIGS. 1 and 2 comprises a row of needles 1*a*, which are disposed between a first cover plate 2*a* and a second cover plate 3*a*. The needles can be joined by gluing or soldering them together. In particular, cover plates 2*a* and 3*a* are provided when the needles are glued together. A point region 4*a* is formed by swaging the needles, starting at a point 5*a*, and reducing their original thickness. The remaining section is designated the shaft 6*a*. In conventional needle combs, the shaft region 7*a* is mostly covered by cover plates 2*a* and 3*a*; at the most, approximately only 1 mm of the shaft region remains uncovered.

Open passageways F exist between the needles 1*a*, these passageways being determined by the ratio of the thickness of the swaged point regions 4*a* to that of the unworked shaft 6*a*. The width of the shaft 6*a* determines how many needles per unit length of needle strip are provided, since the shafts 6*a* are packed tightly together. The length of the protruding needle points 4*a* is designated the projection V.

FIG. 1 shows how contaminants 8*a* are deposited in the open passageway F between the needles and thereby reduce the combing action of the comb.

Figure 3:
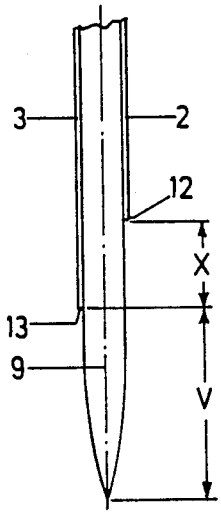
FIG. 3 shows a cross section of a needle strip according to the invention, parallel to the longitudinal axis of the needles.
Figure 4:
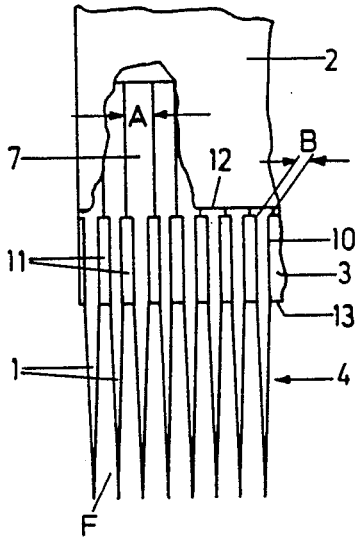
FIG. 4 shows a partial cutaway view of a needle strip as in FIG. 3.

In an advantageous embodiment of the invention, noting FIGS. 3 and 4, provision is made for the first cover plate 2 to be made shorter in the direction of the longitudinal axis of the needles 9 than the second cover plate 3, and this by an amount greater than an additional swaged section 10 of length X of the needles 1. This additional swaged section 10 causes air channels 11 between the needles 1, which air channels extend from below the bottom edge 12 of the first shorter cover plate 2 down to the bottom edge 13 of the second longer cover plate 3, and which open out into the open passageways F between any two adjacent needles 1. Due to the swagings 10, the needles in this region have a reduced width B compared to width A in the shaft 7 region.

Figure 5:
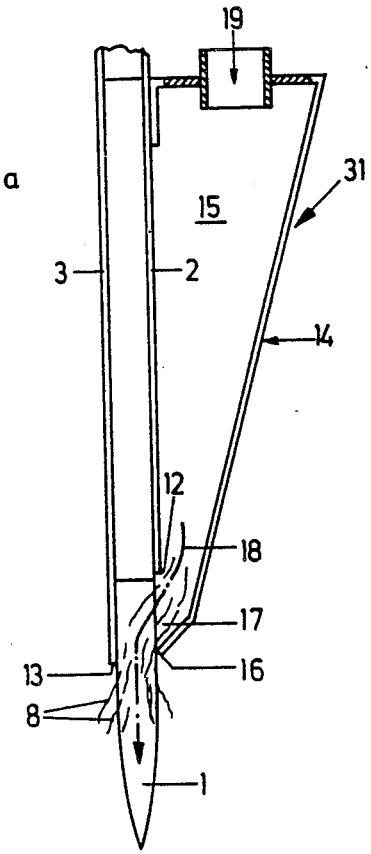
FIG. 5 shows a section corresponding to FIG. 3 with a baffle.

In order to direct a flow of air at the air channels 11, a baffle 14— as shown in FIG. 5— is provided, which is joined at all edges with the first cover plate 2, forming an air chamber 15, wherein only the bottom edge 16 of the baffle 14 extends beyond the bottom edge 12 of the first cover plate 2 to approximately the level of the bottom edge 13 of the second cover plate or baffle 3, resulting in an open side passage 17, e.g. for a flow of compressed air 18 which is introduced from a compressed air source into the air chamber 15 via a feed line 19, and which then reaches the air channels 11 between the needles 1 via this passage 17. This construction provides a kind of nozzle formed by the parallel bottom edges 13, 16 of the second cover plate 3 and/or of the baffle 14, so that the contaminants 8 are carried along by the flow of air 18.

Figure 8:
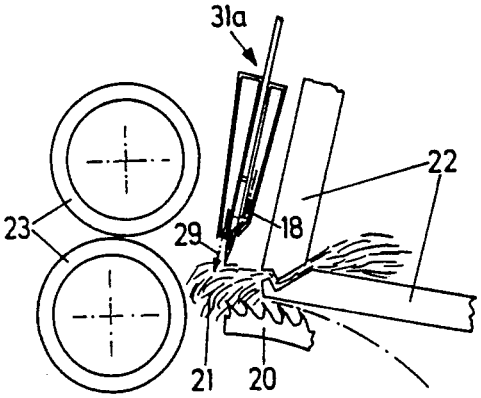
FIG. 8 shows a section to illustrate the arrangement of a comb as shown in FIG. 6 on a cotton combing machine.

FIG. 8 shows schematically how a needle strip 31 or 31*a* according to the invention is disposed in a combing machine. FIG. 8 thus illustrates a section of a circular comb 20 engaged in a fiber tuft 21 that is periodically grasped and released by opening and closing jaws 22. The top comb (needle strip 31*a*) is disposed above the circular comb 20, whereby the fiber tuft 21 is drawn through two take-up rollers 23 and thereby drawn through the spaces between the needles 1 of the top comb (needle strip 31*a*). It is clear from the geometry shown in FIG. 8 that the flow of air 29 presses the fiber tuft 21 downward against the circular comb 20.

Figure 6:
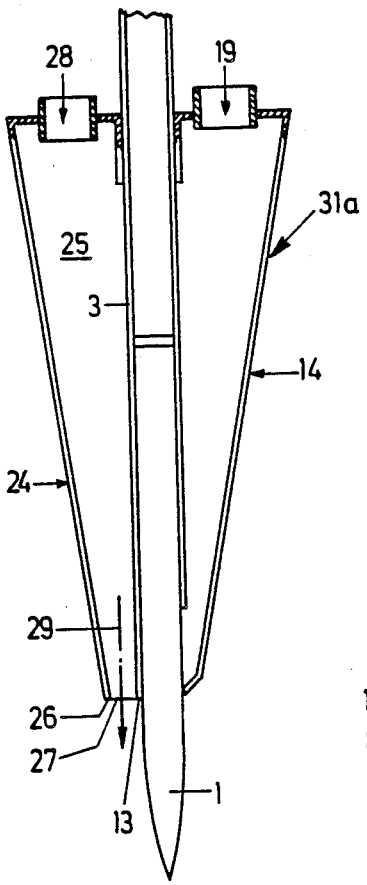
FIG. 6 shows an embodiment corresponding to FIG. 5, with an additional air nozzle for exerting pressure on the fiber tuft.

In order to reinforce this desirable effect even more, the embodiment shown in sectional view in FIG. 6 is provided with a second baffle 24, connected to the second cover plate 3, forming an air chamber 25 in such a way that the bottom edge 26 of the baffle 24 ends in the vicinity of the bottom edge 13 of the second cover plate 3, forming a nozzle 27 through which a flow of compressed air 29 introduced through an inlet opening 28 is able to exit and thus further reinforce the effect of pressing the fiber tuft 21 against the circular comb 20.

Figure 7:
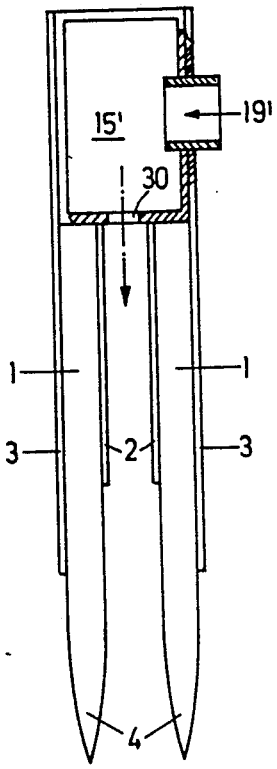
FIG. 7 shows an embodiment for a double top comb.

A double top comb is shown in FIG. 7, consisting of two needle strips extending parallel to each other, which in essence are constructed the same way as shown in connection with FIG. 3. In this embodiment, the air chamber 15', which has an inlet 19', is formed by extending the outer cover plates 3 upward past the needles 1, thus closing off the sides of the enclosed air chamber 15'. The air chamber 15' has an outlet opening 30, through which the flow of air entering at 19' can be directed at the point region 4 of the needles 1.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. For example, it will be understood that the decreased diameter of the needle ends can be effected also in ways other than by die cutting and swaging.

What is claimed is:

1. Needle strip, in particular a top comb, for textile machinery and the like, comprising at least one row of needles and first and second cover plates, said first and second cover plates holding in place said row of needles, wherein the points of the needles extend to a certain distance past the bottom edge of said cover plates, thus forming open passageways between the needles, and wherein a cleaning appliance for the removal of deposits that have settled in the open passageways is associated with the needle strip, characterized in that the needle strip comprises at least one air channel (11) in order to conduct a flow of air (17) through or past the open passageways (F) to clean them.

2. Needle strip according to claim 1, characterized in that at least some of the air channels (11) are formed by an extension, in the direction of shafts of said needles (1), of the open passageways (F) between the needle points (4).

3. Needle strip according to claim 1, characterized in that the first cover plate (2) is shorter, viewed in the direction along the longitudinal axis of the needle (9), than the second cover plate (3), with the bottom edge (12) of the first cover plate located in the vicinity of the beginning of the air channel (11), and in that a first baffle (14) lies outside the first cover plate (2) and extends to the vicinity of the bottom edge (13) of the second cover plate (3), said baffle forming a closed air chamber (15,15') leading to a feed or exhaust line (19,19').

4. Needle strip according to claim 1, wherein each needle is die cut and that the point region of the needles receives swaging on both sides, so that the thickness of the needles in their point regions is reduced compared to that of the remaining shaft region, characterized in that the swaging (10) extends past the point region (4), so that air channels (11) are formed beyond the point region (4) in the shaft region (7).

5. Needle strip according to claim 4, characterized in that the length (X) of the air channels (11) thus formed is approximately 15 to 100% of needle projection (V) over said first and second cover plates.

6. Needle strip according to claim 5, wherein said length (X) is about 60% of the length of projection (V) of the needle over said first and second cover plate.

7. Needle strip according to claim 1, characterized in that an additional air outlet opening (nozzle 27) is disposed in the vicinity of the needle points (4).

8. Needle strip according to claim 7, characterized in that the additional air outlet opening (nozzle 27) is formed by a second baffle (24) disposed outside the second cover plate (3).

9. Needle strip comb for textile machinery, comprising at least two rows of needles, characterized in that an air chamber (15') is disposed between the two rows of needles (1), and further comprising means for blowing air through said air chamber and between said two rows of needles.

10. Process according to claim 9, characterized in that the needle strip (31,31*a*) is loaded with air in a pulsating fashion.

11. Process according to claim 10, characterized in that said air pulses are triggered by a timing circuit clock.

12. Process for cleaning a needle strip which forms part of a combing machine, the needle strip having at least one row of needles held in place especially between first and second cover plates, wherein points of the needles extend a certain distance past the bottom edge of the cover plates, thus forming open passageways between the needles, the needle strip further having at least one air channel in order to conduct a flow of air through or past the open passageways to clean them, comprising cleaning the needle strip by compressed air.

13. Process according to claim 10, characterized in that air pulses are triggered depending on a combing cycle, or on movements of another component of the combing machine whose actuation is coordinated.

* * * * *